United States Patent [19]

Marquez

[11] Patent Number: 4,597,430

[45] Date of Patent: Jul. 1, 1986

[54] WINDOW SHADE SEALING SYSTEM

[76] Inventor: Fidencio G. Marquez, 619 Ocean Blvd., Coronado, Calif. 92118

[21] Appl. No.: 576,906

[22] Filed: Feb. 3, 1984

[51] Int. Cl.[4] ..... E06B 9/17

[52] U.S. Cl. ..... 160/269; 160/23 R

[58] Field of Search ..... 160/266, 273 C, 368 R, 160/268 R, 273 R, 271, 269

[56] References Cited

U.S. PATENT DOCUMENTS

| | | | |
|---|---|---|---|
| 785,226 | 3/1905 | McCoy | 160/271 |
| 808,695 | 1/1906 | Smith et al. | 160/271 |
| 3,882,921 | 5/1975 | Sandall | 160/266 |
| 4,126,952 | 11/1978 | Moriarty et al. | 160/271 |
| 4,220,189 | 9/1980 | Marquez | 160/269 |
| 4,246,952 | 1/1981 | Helldorfer | 160/271 |
| 4,258,517 | 3/1981 | Hammond | 160/269 |
| 4,357,978 | 11/1982 | Keller et al. | 160/271 |
| 4,369,827 | 1/1983 | Andersen | 160/269 |

FOREIGN PATENT DOCUMENTS

| | | | |
|---|---|---|---|
| 2060744 | 5/1981 | United Kingdom | 160/268 R |

*Primary Examiner*—Ramon S. Britts
*Assistant Examiner*—Cherney S. Lieberman
*Attorney, Agent, or Firm*—Ralph S. Branscomb

[57] ABSTRACT

A window shade sealing system is provided having a pair of vertically oriented side panels which capture the side edges of a shade as it is pulled down, and a pair of baffles mounted respectively at the top and bottom of the window frame to respectively seal off the shade roller, and the bottom shade slat, from the window so that cold air between the window and the shade, and air leaking around the window casement, is trapped and prevented from entering the building.

1 Claim, 9 Drawing Figures

WINDOW SHADE SEALING SYSTEM

BACKGROUND OF THE INVENTION

It is common knowledge in the building trades and among building owners that according to the techniques of conventional building construction, walls are much more heat insulative than windows. Accordingly, in the wintertime in the cooler climates a large portion of the heat that is lost is lost through the glass of the windows.

The loss is both from conduction through the glass, which is reduced when dual glazing is used, and also there is generally at least some draft around the sides of the windows, especially in older houses. Naturally, if there is a draft, the fact that the glass itself may be dual glazed is of no help.

Applicant is inventor of a window shade sealing system which is described in U.S. Pat. No. 4,220,189. That system utilized a channel for passing around the side edges in the bottom of the shade, and a housing covering the shade roller. Although that system was quite effective, the inventor felt the need to provide a sealing system which was less bulky, and even more inexpensive.

SUMMARY OF THE INVENTION

The inventor has fulfilled the above-stated need by providing a new, improved, window shade sealing system whereby the two side edges of the shade are captured in channels as with the prior invention, but the enclosed housing which was used in the prior invention to seal the top of the shade has been replaced by a simple baffle which ideally rests slightly on the roller of the shade. This baffle is duplicated at the bottom of the shade to replace the U-shaped channel, so that only two types of sealers are used, the baffle type used at the top and bottom of the shade, and channel types which run vertically at the edges of the shade.

All of the members are provided with a strip of adhesive-backed foam to permit the strips to seal well even over irregular surfaces, and the upper front portion of the side channels are cut away to facilitate the initiation of the upper portion of the shade therein.

DETAILED DESCRIPTION OF THE PREFERRED EMBODIMENT

Figure 1:
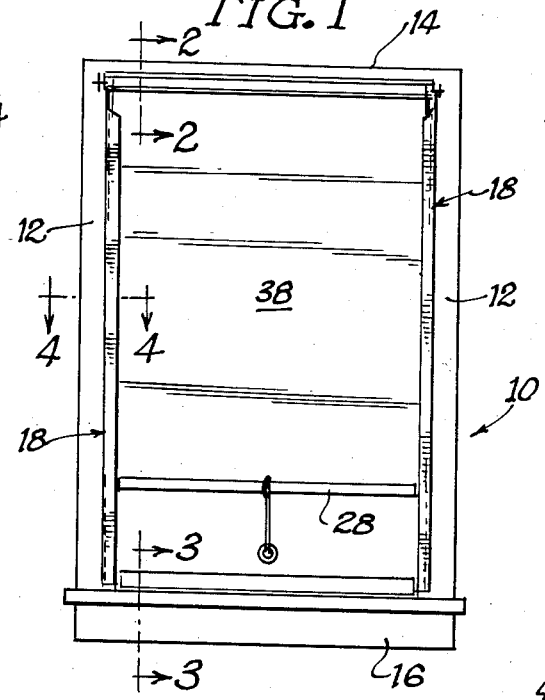
FIG. 1 is a front elevation view of a window showing the sealing system in place.

A window casing is shown in FIG. 1 having a frame 10 with two side frame members 12, and top and bottom members 14 and 16, respectively.

Figure 4:
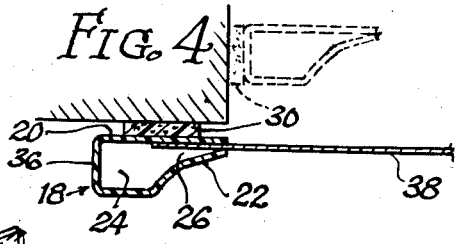
FIG. 4 is a plan view of the top of one of the channels in place taken on line 4—4 of FIG. 1.

The channels 18, best shown in FIG. 4, have a flat base 20 and an arched forward portion 22, which together define a bay 24 with a closed mouth 26 so that as the shade is pulled through, the front and back portions of the channel close upon the shade after the initial slat 28 is pulled through. The channel therefore must be made of a material that has at least some resilience to perform optimally. Entrance portion 29 at the tops of the channels permits the slat 28 to be easily inserted into the bay.

On the back of the base, is a strip of foam 30 covered with a layer of adhesive 32, and sold with the protective strip 34 in place.

Figure 8:
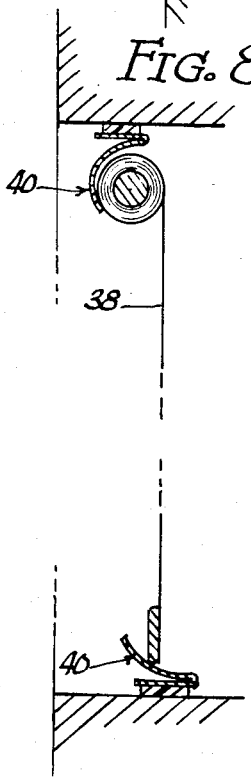
FIG. 8 is a view similar to FIG. 7 but showing the system mounted in a wood frame casing which defines horizontal attachment surfaces; the baffles can be mounted either to a horizontal or vertical surface; and, FIG. 9 illustrates a roll of either the baffle or channel as it might appear if provided in flexible roll form.
Figure 5:
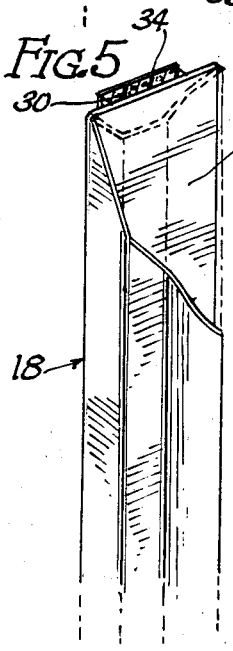
FIG. 5 is a perspective view illustrating the cutaway portion at the top of the left channel.
Figure 6:
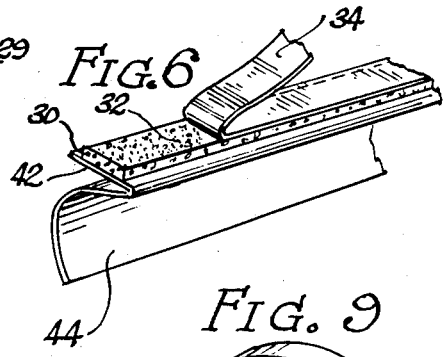
FIG. 6 is a perspective illustrating the adhesive backing of a baffle with a protective sheet peeled back.

The side channels can be mounted to the front of the window frame as shown in FIG. 4 and 6 merely by peeling off the protective strip 34 and pressing the strips into place. If they are to be mounted inside the window casing as shown in FIG. 8, the adhesive strip can be applied to the back 36 of the channel. Either way, as shown in FIG. 4, the shade cloth 38 is captured in a channel and slides under light pressure through the mouth 26 of the channel on each side of the window.

lhe upper and lower horizontal members are identical and comprise baffles 40 with a flat mounting base 42 and an arched lip 44 that depends from the upper part of the window frame, or projects upwardly from the bottom part of the frame.

Figure 2:
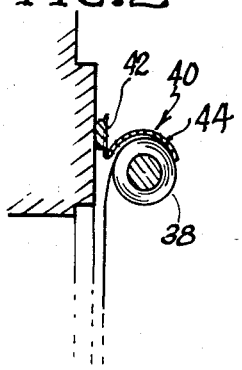
FIG. 2 is a section through line 2—2 of FIG. 1.

FIG. 2 illustrates the top-mounted baffle mounted to a vertical surface, so that the lip extends generally horizontally over the shade roller. The lip should come in brushing contact with the roller to provide a positive seal.

As shown in FIG. 8, the upper baffle could be mounted to a horizontal surface with the lip depending into contact with the shade roller.

Figure 7:
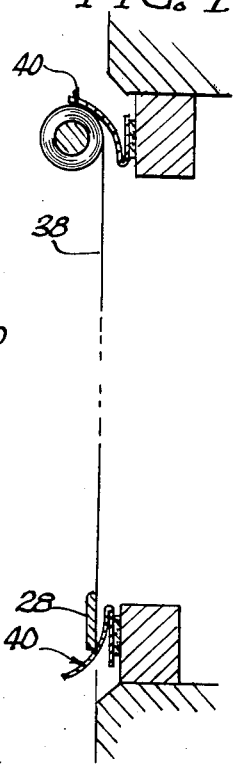
FIG. 7 illustrates utilization of the system on a window casing embedded in plaster, wherein vertical surfaces are used to mount the system.
Figure 3:
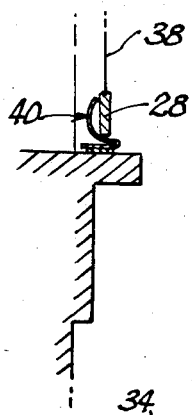
FIG. 3 is a section taken along line 3—3 of FIG. 1.

The lower baffle could also be mounted either vertically or horizontally, as illustrated in FIGS. 7, 8 and 3. Although when the baffle is used at the lower portion of the window it does not positively engage the shade slat 28, nevertheless if it is positioned properly the weight of the slat against the baffle will have a positive sealing effect.

Although the baffle is shown in the form with the flat base on the arched lip, there are innumerable configurations in which the baffle could be provided. The only real limitations on the baffle design are that it should have one surface to mount to the window casing, and some type of extension, preferably somewhat resilient, which extends from the base out into contact with the shade roller. The extension could be flat, curved in the opposite direction, or otherwise configured differently than that shown, with the variations being too many to try to illustrate.

Clearly, there also could be alternative matters of mounting the baffles for different window configurations not shown in the drawings.

Figure 9:
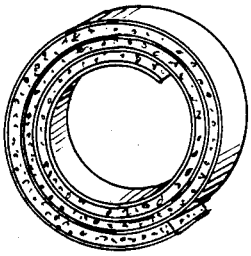

Both the baffles and the channels could be provided in stock that is resilient enough to be folded flat and provided as a roll as shown in FIG. 9. lt might not be flattened, but still provided in flexible form as a single length of baffle extrusion and a single length of channel extrusion, to be cut to size on the spot. Unless the baffles and channels are made flexible, a single length would be too long for practical purposes, and the channels and baffles would need to be sold as two separate parts.

The invention reduces the window sealing system to its lowest elemental, inexpensive, and easy to understand form. For just pennies worth of material, and without any tools at all, the system can be applied around virtually any shade configuration, with the result that a large portion of the energy formerly being dissipated through window glass and around the window frames will be saved, and the average household would notice a significant drop in winter heating bills.

What is claimed is:

1. A window shade sealing system for a window having a generally rectangular frame, with a window shade roller mounted at the top to enable the shade to be unrolled from the roll by pulling the leading edge, said system comprising:

(a) a pair of resilient side channels and means to fasten them to the sides of the window frames such as to capture the side edges of a shade as it is being pulled down into operative position;

(b) a lower baffle mounted to the bottom of the window frame to define a lip spaced from the window to provide a surface against which the lower edge of said shade seats;

(c) an upper baffle mounted to the upper portion of said window frame and having a continuous extending lip extending into adjacency with the rolled portion of said shade; and (d) said lower baffle and upper baffle being identical in cross-section and resilient and each having a v-shaped cross sectional portion with one side substantially flat with an adhesive strip mounted thereon, and the other side flared to define an arc in cross section, width the arc being concave in substantially the opposite direction from said opening of v-shaped cross sectional portion and being shaped and dimensioned to be of greater radius than a rolled shade to permit the lip of said baffle opposite said v-shaped cross-sectional portion to continuously bear against the rolled shade as same decreases in radius as it is unrolled, and to permit the same baffle to be used at the bottom of the shade, with said lip of said baffle contacting the leading edge of said shade.

* * * * *